US005964195A

United States Patent [19]

Sakashita et al.

[11] Patent Number: 5,964,195

[45] Date of Patent: Oct. 12, 1999

[54] WATER-COOLED TYPE INTERNAL COMBUSTION ENGINE

[75] Inventors: Masao Sakashita; Noriaki Kawai; Yasuji Nozawa; Naoaki Takeda, all of Saitama, Japan

[73] Assignee: Honda Giken Kogyo Kabushiki Kaisha, Tokyo, Japan

[21] Appl. No.: 08/985,369

[22] Filed: Dec. 4, 1997

[30] Foreign Application Priority Data

Dec. 27, 1996 [JP] Japan ..... 8-351228

[51] Int. Cl.[6] ..... F02B 75/06

[52] U.S. Cl. ..... 123/192.1

[58] Field of Search ..... 123/192.1, 41.01, 123/41.5

[56] References Cited

U.S. PATENT DOCUMENTS

| | | | |
|---|---|---|---|
| 1,466,219 | 8/1923 | Winans | 123/41.5 |
| 1,867,351 | 5/1932 | Carpentier | 123/41.5 |
| 2,525,994 | 10/1950 | Bober | 123/41.5 |
| 3,889,841 | 6/1975 | Edmonds | 123/41.5 |

FOREIGN PATENT DOCUMENTS

| | | | |
|---|---|---|---|
| 5005 | of 1893 | United Kingdom | 123/41.5 |
| 2 134 974 | 8/1984 | United Kingdom . | |

OTHER PUBLICATIONS

Patent Abstract of JP 58107839 Jun. 1983.

Patent Abstract of JP 60261959 Dec. 1985.

Patent Abstract of JP 57102539 Jun. 1982.

*Primary Examiner*—Noah P. Kamen
*Attorney, Agent, or Firm*—Lyon & Lyon LLP

[57] ABSTRACT

A water-cooled type internal combustion engine includes a cylinder provided in a cylinder block of an engine body and having a piston slidably received therein, and a cooling water passageway defined in the engine body and including a cooling water portion surrounding the cylinder. In the water-cooled type internal combustion engine, a through-bore is provided at that portion of an outer wall of the engine body which faces the cooling water passageway, a vibration absorbing means is mounted to the outer wall surface of the engine body to close the through-bore. The vibration absorbing means includes a resilient membrane which is disposed so that its peripheral edge does not protrude from an inner surface of the outer wall into the cooling water passageway, and which has one surface facing the cooling water passageway and the other surface facing a space area.

24 Claims, 11 Drawing Sheets

WATER-COOLED TYPE INTERNAL COMBUSTION ENGINE

BACKGROUND OF THE INVENTION

1. Field of the Invention

The present invention relates to a water-cooled type internal combustion engine including a cylinder provided in a cylinder block of an engine body and having a piston slidably received therein, and a cooling water passageway defined in the engine body and surrounding the cylinder, and particularly, to an improvement in the structure of such a water-cooled type internal combustion engine, w her e in a piston slap sound produced by the collision of the piston against an inner surface of the cylinder is reduced.

2. Description of the Related Art

In reducing the piston slap sound in the cylinder block structure in the water-cooled type internal combustion engine, at least the five following techniques have been conventionally employed. First (1), a technique in which the wall thickness of the cylinder is increased to suppress the amplitude of a vibration to a small level. Second (2), a technique in which the wall thickness of an outer wall of the cylinder block is increased to suppress the amplitude of a vibration. Also known are three structures designed to inhibit the vibration of the non-compressible cooling water existing in the cooling water passageway. Third (3), a structure in which an expandable member such as a gas-encapsulated bellows is mounted in the outer wall of the cylinder block in such a manner that it is disposed in the cooling water passageway, as disclosed in Japanese Utility Model Application Laid-open No.57-101345. Fourth (4), a structure in which a sound shielding layer is provided in the cylinder block outside the cooling water passageway with a partition wall interposed therebetween, as disclosed in Japanese Utility Model Application Laid-open No.53-68814. Fifth (5), a structure in which a sponge-like damper material covered with a metal plate is affixed to an inner surface of the outer wall of the cylinder block in the cooling water passageway, as disclosed in Japanese Patent Application Laid-open No.57-102539.

However, in the techniques (1) and (2), the weight of the engine body is increased due to increases in wall thickness of the cylinder and the cylinder block. In the structure (3), the existence of the expandable member in the cooling water passageway causes the flow of the cooling water in the cooling water passageway to be hindered, bringing about a reduction in cooling performance, and also the spring characteristic of the expandable member is varied in accordance with a variation in internal pressure of a gas in the expandable member depending upon the temperature of the cooling water, thereby reducing the vibration damping effect by half during operation of the engine. In the structure (4), the cooling water passageway and the sound shielding layer are disposed with the partition wall interposed therebetween to provide a double structure and hence, this structure is complicated and difficult to manufacture, resulting in an increase in manufacture cost, and bringing about an increase in weight of the engine body. Further, in the structure (5), the presence of the damper material covered with the metal plate in the cooling water passageway causes the flow of the cooling water in the cooling water passageway to be hindered, bringing about a reduction in cooling performance.

SUMMARY OF THE INVENTION

Accordingly, it is an object of the present invention to provide a water-cooled type internal combustion engine, wherein the above-described problems are solved, and the piston slap sound can be effectively reduced in a simple structure which causes no reduction in cooling performance and no significant increase in weight of the engine body.

To achieve the above object, according to a first aspect and feature of the present invention, there is provided a water-cooled type internal combustion engine comprising a cylinder provided in a cylinder block of an engine body and having a piston slidably received therein, and a cooling water passageway defined in the engine body and including a water passage portion surrounding the cylinder, wherein the internal combustion engine further includes a through-bore provided at that portion of an outer wall of the engine body which faces the cooling water passageway, and a vibration absorbing means mounted to the outer wall surface of the engine body to close the through-bore, and including a resilient membrane which is disposed so that its peripheral edge does not protrudes from an inner surface of the outer wall into the cooling water passageway, and which has one surface facing the cooling water passageway and the other surface facing a space area.

With such arrangement, a vibration produced as a result of the collision of the piston against an inner surface of the cylinder induces a vibration of the cooling water in the cooling water passageway. However, a variation in pressure of the cooling water is absorbed by the flexure of the resilient membrane having the one surface facing the cooling water passageway, thereby effectively reducing the vibrating force applied from the cooling water to the outer wall of the engine body to reduce the piston slap sound radiated from the engine body. Moreover, since the peripheral edge of the resilient membrane does not protrude from the outer wall of the engine body into the cooling water passageway, it is possible to avoid the hindrance by the resilient membrane of the flow of the cooling water in the cooling water passageway to the utmost, and to smooth the flow of the cooling water in the cooling water passage to maintain the cooling performance. In addition, the space area faced by the other surface of the resilient membrane cannot be surrounded by the cooling water passageway, and even if a variation in temperature of the cooling water is produced, the temperature of a gas in the space area is varied only in a small amount. Even if the space area is tightly closed, the variation in pressure in the space area can be suppressed to a very small level and hence, an excellent vibration absorbing effect can be obtained during operation of the engine. Further, since the vibration absorbing means is mounted to a portion of the outer wall surface of the engine body, it is possible to suppress the increase in weight of the engine body due to the mounting of the vibration absorbing means to a small level.

According to a second aspect and feature of the present invention, in addition to the first feature, a plurality of the cylinders equal to three or more are disposed in parallel in the cylinder block, and the vibration absorbing means is mounted to the cylinder block at an intermediate location in a direction of the arrangement of the cylinders.

In the multi-cylinder water-cooled type internal combustion engine including the three or more cylinders, it has been confirmed by experiments made by the present inventors that the amplitude of the vibration of the cooling water is increased at the intermediate location in the direction of the arrangement of the cylinders. However, by the disposition of the vibration absorbing means at the location at which the vibration amplitude is larger, the piston slap sound can be more effectively reduced by a small number of vibration absorbing means.

The above and other objects, features and advantages of the invention will become apparent from the following description of the preferred embodiments taken in conjunction with the accompanying drawings.

BRIEF DESCRIPTION OF THE DRAWINGS

FIGS. 1 to 5 illustrate a first embodiment of the present invention, wherein FIG. 1 is a perspective view of a cylinder block in a 4-cylinder water-cooled type internal combustion engine;

FIG. 2 is an enlarged sectional view taken along the line 2—2 in FIG. 1;

FIG. 3 is a view taken in the direction of the arrow 3 in FIG. 2;

FIG. 4 is a diagram showing a mode of vibration of an outer wall surface of a cylinder block in the direction of the arrangement of cylinders;

FIG. 5 is a diagram showing the acceleration characteristic with respect to the frequency in comparison with that in the prior art;

DETAILED DESCRIPTION OF THE PREFERRED EMBODIMENTS

Figure 1:
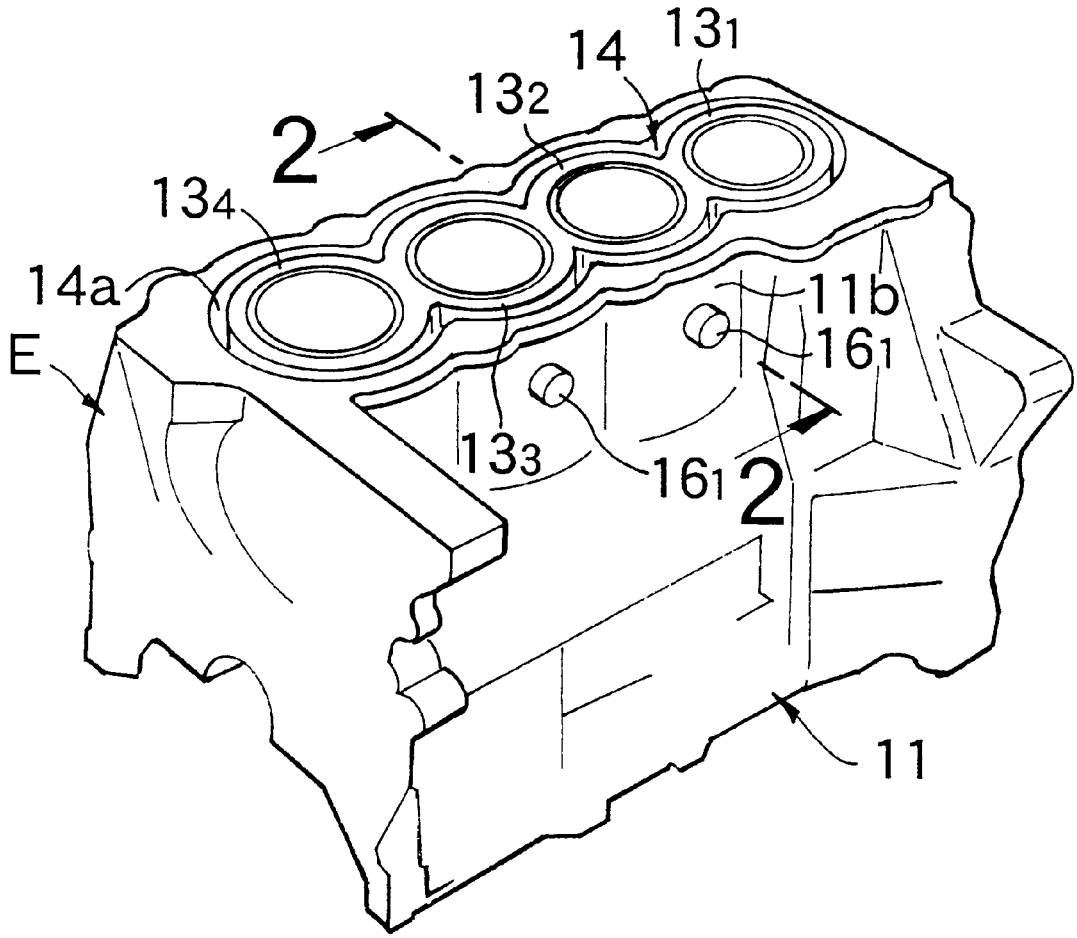
Figure 2:
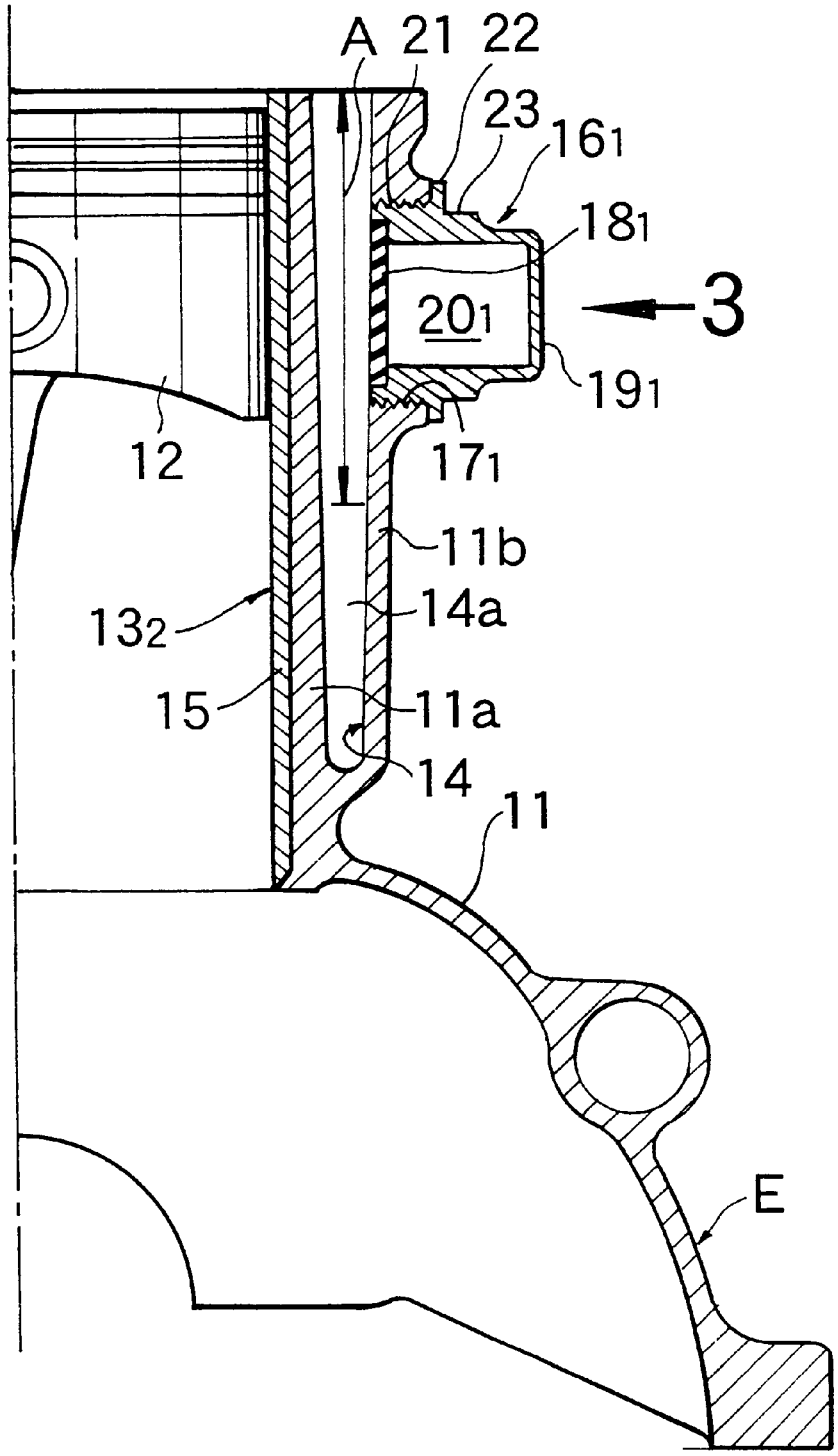

A first embodiment of the present invention will now be described with reference to FIGS. 1 to 5. Referring first to FIGS. 1 and 2, a cylinder block 11 in a water-cooled type 4-cylinder internal combustion engine constitutes an engine body E together with a cylinder head, an oil pan and the like (not shown). First, second, third and fourth cylinders $\mathbf{13}_1$, $\mathbf{13}_2$, $\mathbf{13}_3$ and $\mathbf{13}_4$ are provided in parallel in the cylinder block 11, and pistons 12 are slidably received in the first, second, third and fourth cylinders $\mathbf{13}_1$, $\mathbf{13}_2$, $\mathbf{13}_3$ and $\mathbf{13}_4$, respectively. Each of the cylinders $\mathbf{13}_1$, $\mathbf{13}_2$, $\mathbf{13}_3$ and $\mathbf{13}_4$ is comprised of cylinder liner 15 formed in a cast-in manner on an inner wall 11*a* included in the cylinder block 11 in this embodiment, but may be comprised of an inner wall 11*a* having a ground inner surface rather than a liner. A cooling water passageway 14 is defined in the engine body E and includes a water passage portion 14*a* defined in the cylinder block 11 to commonly surround the cylinders $\mathbf{13}_1$, $\mathbf{13}_2$, $\mathbf{13}_3$ and $\mathbf{13}_4$. A small gap is left between an outer surface of each of the pistons 12 and an inner surface of each of the cylinders $\mathbf{13}_1$, $\mathbf{13}_2$, $\mathbf{13}_3$ and $\mathbf{13}_4$. When the piston 12 is vertically moved in each of the cylinders $\mathbf{13}_1$, $\mathbf{13}_2$, $\mathbf{13}_3$ and $\mathbf{13}_4$, it collides against the inner surface of each of the cylinders $\mathbf{13}_1$, $\mathbf{13}_2$, $\mathbf{13}_3$ and $\mathbf{13}_4$ to vibrate each of the cylinders $\mathbf{13}_1$, $\mathbf{13}_2$, $\mathbf{13}_3$ and $\mathbf{13}_4$, and such vibration is transmitted to the cooling water in the cooling water passageway 14. The cooling water is non-compressible and hence, a variation in pressure is produced even by such a slight vibration. A vibrating force produced by the variation in pressure of the cooling water is applied to an outer wall 11*b* of the cylinder block 11 facing the cooling water passageway 14, thereby vibrating the outer wall 11*b* to radiate a piston slap sound to the outside.

Therefore, vibration absorbing means $\mathbf{16}_1$ for absorbing the vibration of the cooling water in the cooling water passageway 14 to inhibit the application of the vibrating force to the outer wall 11*b* of the cylinder block 11 to the utmost to reduce the piston slap sound are mounted to the outer wall 11*b* of the cylinder block 11 at locations corresponding to sleeve bore centers of the second and third cylinders $\mathbf{13}_2$ and $\mathbf{13}_3$ which lie in intermediate locations in the direction of the arrangement of the cylinders $\mathbf{13}_1$, $\mathbf{13}_2$, $\mathbf{13}_3$ and $\mathbf{13}_4$. Threaded bores $\mathbf{17}_1$ as through-bores are provided in the outer wall 11*b* of the cylinder block 11 in correspondence to the vibration absorbing means $\mathbf{16}_1$.

The vibration absorbing means $\mathbf{16}_1$ includes a resilient membrane $\mathbf{18}_1$ having one surface facing the water passage portion 14*a* of the cooling water passageway 14, and a housing $\mathbf{19}_1$ which defines a space area $\mathbf{20}_1$ between the housing $\mathbf{19}_1$ and the other surface of the resilient membrane $\mathbf{18}_1$.

Figure 3:
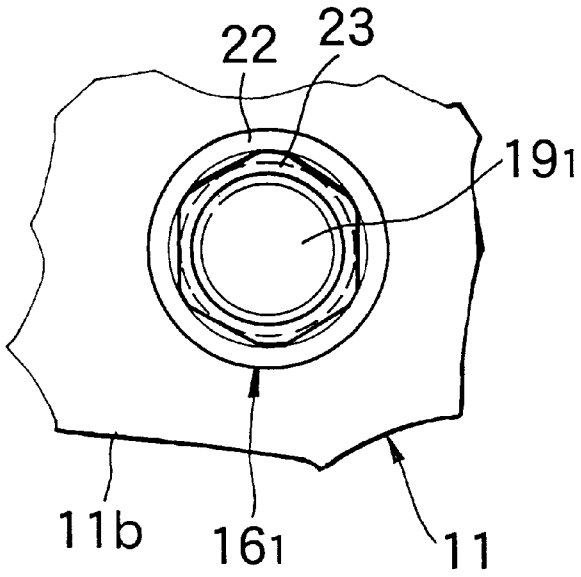

Referring also to FIG. 3, the housing $\mathbf{19}_1$ is formed into a bottomed cylinder-like shape with its outer end closed by a metal material having a substantial rigidity. Formed on an outer surface of the housing $\mathbf{19}_1$ are, in sequence from its inner end, an externally threaded portion 21 which is threadedly inserted into the threaded bore $\mathbf{17}_1$, an engage collar portion 22 which protrudes outwards from the externally threaded portion 21, and an engaging portion 23 which is formed, for example, into a substantially hexagonal shape for engagement of a rotative operating tool such as a wrench.

The distance from the inner end of the housing $\mathbf{19}_1$ to the engage collar portion 22 is set such that when the externally threaded portion 21 is threadedly engaged into the threaded bore $\mathbf{17}_1$ until the engage collar portion 22 engages with and abuts against the outer wall surface of the cylinder block 11. The inner end of the housing $\mathbf{19}_1$ does not protrude from the inner end of the threaded bore $\mathbf{17}_1$ into the cooling water passageway 14.

The resilient membrane $\mathbf{18}_1$ is formed from a rubber, a synthetic resin or a metal which is reinforced with a fabric, a synthetic fiber or a glass fiber for the purpose of enhancing the durability of the resilient membrane $\mathbf{18}_1$. The resilient membrane $\mathbf{18}_1$ is secured at its peripheral edge to the inner end of the housing $\mathbf{19}_1$, for example, by baking or the like to close the inner end of the bottomed cylindrical housing $\mathbf{19}_1$. Moreover, the peripheral edge of the resilient membrane $\mathbf{18}_1$ is secured to the inner end of the housing $\mathbf{19}_1$, for example, flush with the inner end of the housing $\mathbf{19}_1$, so that it cannot protrude from the inner surface of the outer wall 11*b* of the cylinder block 11 into the cooling water passageway 14.

It is desirable that the positions of disposition of the threaded bore $\mathbf{17}_1$ and the vibration absorbing means $\mathbf{16}_1$ are near a location in which the piston 12 gives a blow against inner surfaces of the cylinders $\mathbf{13}_2$ and $\mathbf{13}_3$. It is known that the timing of generation of a slap vibration to a crank angle is within 25 degree before and after a top dead center position of the piston 12. Therefore, if a sum of the amount of piston displaced at 25 degree before and after the top dead center and the axial length of the piston 12 is represented by A in FIG. 2, it is desirable that the threaded bore $\mathbf{17}_1$ and the vibration absorbing means $\mathbf{16}_1$ are disposed in a range of A from the upper surface of the cylinder block 11.

Figure 4:
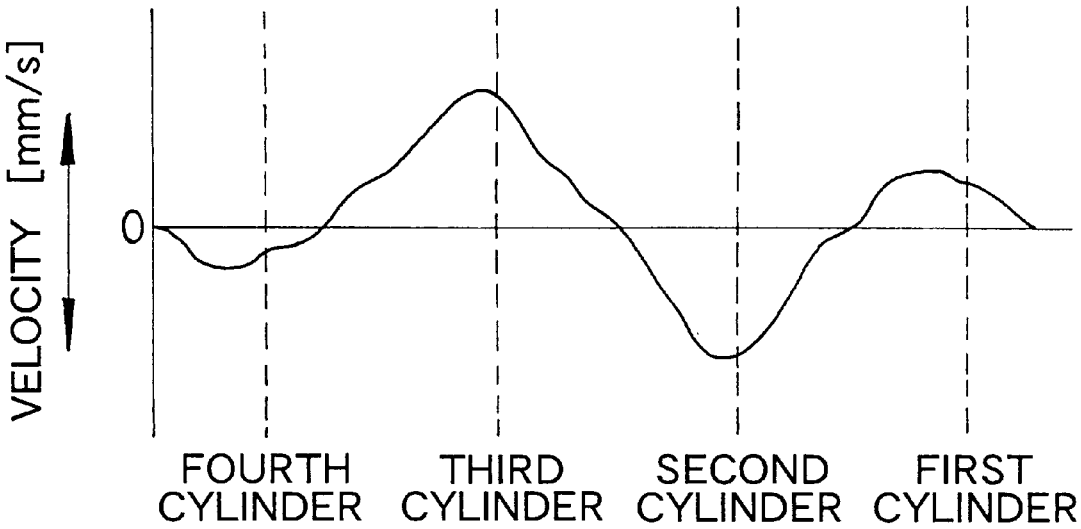

The experiment made by the present inventors showed that the velocity [mm/s] of a vibration produced by a blow applied to each of the cylinders $13_1$, $13_2$, $13_3$ and $13_4$ by the piston 12 is varied as shown in FIG. 4 in the direction of the arrangement of the cylinders $13_1$, $13_2$, $13_3$ and $13_4$ and is increased at portions corresponding to the sleeve bore centers of the second and third cylinders $13_2$ and $13_3$ lying at intermediate portions in the direction of the arrangement of the cylinders $13_1$, $13_2$, $13_3$ and $13_4$. Therefore, it is desirable that the threaded bore $17_1$ and the vibration absorbing means $16_1$ are disposed in and on the outer wall 11*b* of the cylinder block 11 at locations corresponding to the sleeve bore centers of the second and third cylinders $13_2$ and $13_3$, as the cylinder block 11 is viewed from a side perpendicular to the direction of the arrangement of the cylinders $13_1$, $13_2$, $13_3$ and $13_4$.

The operation of the first embodiment will be described below. If the pistons 12 collide against the inner surface of the cylinders $13_1$, $13_2$, $13_3$ and $13_4$ to vibrate the cylinders $13_1$, $13_2$, $13_3$ and $13_4$, because the small gaps exist between the outer surf aces of the pistons 12 and the inner surfaces of the cylinders $13_1$, $13_2$, $13_3$ and $13_4$, respectively, such vibration is transmitted to the non-compressible cooling water in the cooling water passageway 14 to induce a variation in pressure of the cooling water. However, the threaded bores $17_1$ are provided in the outer wall 11*b* of the cylinder block 11 at locations facing the water passage portion 14*a* of the cooling water passageway 14, and the vibration absorbing means $16_1$ are mounted on the outer wall 11*b* to close the threaded bores $17_1$. The vibration absorbing means $16_1$ includes the resilient membrane $18_1$ having one surface facing the cooling water passageway 14, and the housing $19_1$ which defines the space area $20_1$ between the housing $19_1$ and the other surface of the resilient membrane $18_1$. Therefore, the variation in pressure of the cooling water is absorbed by flexure of the resilient membrane $18_1$ and hence, the vibrating force applied from the cooling water to the outer wall 11*b* of the cylinder block 11 is effectively reduced. Moreover, the space area $20_1$ faced by the other surface of the resilient membrane $18_1$ is covered with the housing $19_1$ and hence, the sound due to the vibration of the resilient membrane $18_1$ cannot be radiated from the housing $19_1$ to the outside, and the piston slap sound radiated from the cylinder block 11 can be effectively reduced. Further, since the vibration absorbing means $16_1$ are mounted to portions of the outer wall surface of the cylinder block 11, an increase in weight of the cylinder block 11 due to the mounting of the vibration absorbing means $16_1$ can be suppressed to an extremely small value.

Figure 5:
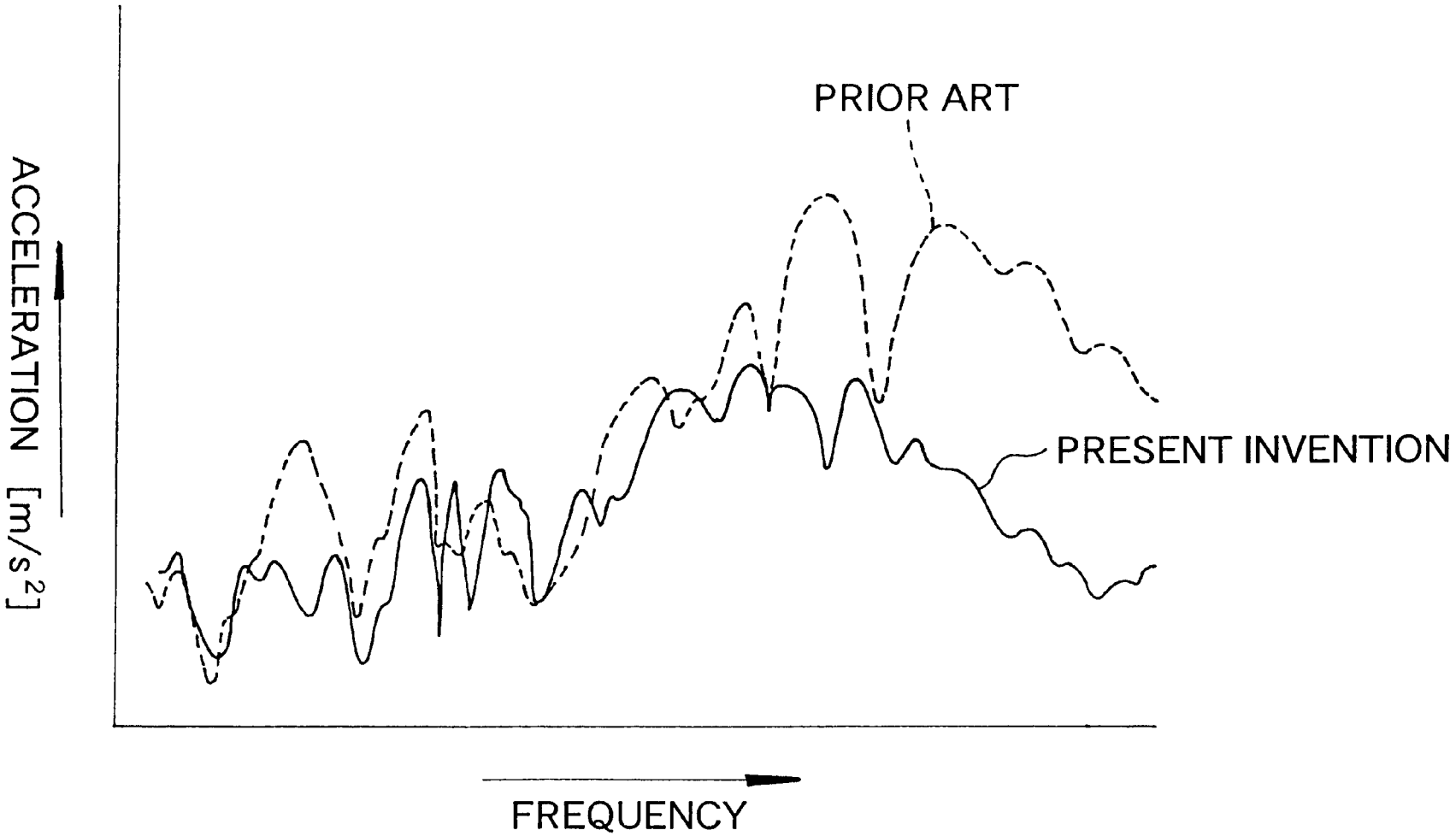

A result of the verification concerning the acceleration [$m/s^2$] of the outer wall 11*b* of the cylinder block 11 at a location corresponding to the third cylinder $13_3$ is as shown in FIG. 5. As is apparent from FIG. 5, in the prior art cylinder block including no vibration absorbing means $16_1$ the acceleration is relatively high as shown by a broken line, and in the internal combustion engine according to the present invention, the acceleration is effectively reduced as shown by a solid line, whereby it can be seen that the piston slap sound can be effectively reduced by the vibration absorbing means $16_1$ according to the present invention.

In addition, since the peripheral edge of the resilient membrane $18_1$ does not protrude from the inner surface of the outer wall 11*b* of the cylinder block 11 into the cooling water passageway 14, the flow of the cooling water in the cooling water passageway 14 by the resilient membrane $18_1$ is not obstructed. Thus, the flow of the cooling water in the cooling water passageway 14 is smooth, thereby maintaining the cooling performance at the same level as in the prior art water-cooled type internal combustion engine equipped with no vibration absorbing means $16_1$.

Moreover, the housing $19_1$ protrudes outwards from the outer wall surface of the cylinder block 11, and the space area $20_1$ is defined between the housing $19_1$ and the resilient membrane $18_1$. Therefore, even if a variation in temperature of the cooling water is produced, the temperature of the gas in the space area $20_1$ is varied only in a small amount, and the variation in pressure in the space area $20_1$ can be suppressed to a very small level. Thus, the vibration characteristic of the resilient membrane $18_1$ can be stabilized, even during a variety of operations of the engine, and an excellent vibration absorbing effect can be obtained.

Further, since the housing $19_1$ of the vibration absorbing means $16_1$ is detachably mounted to the outer wall surface of the cylinder block 11, and the resilient membrane $18_1$ is secured to the housing $19_1$, the replacement and maintenance of the resilient membrane $18_1$ can be easily performed.

Figure 6:
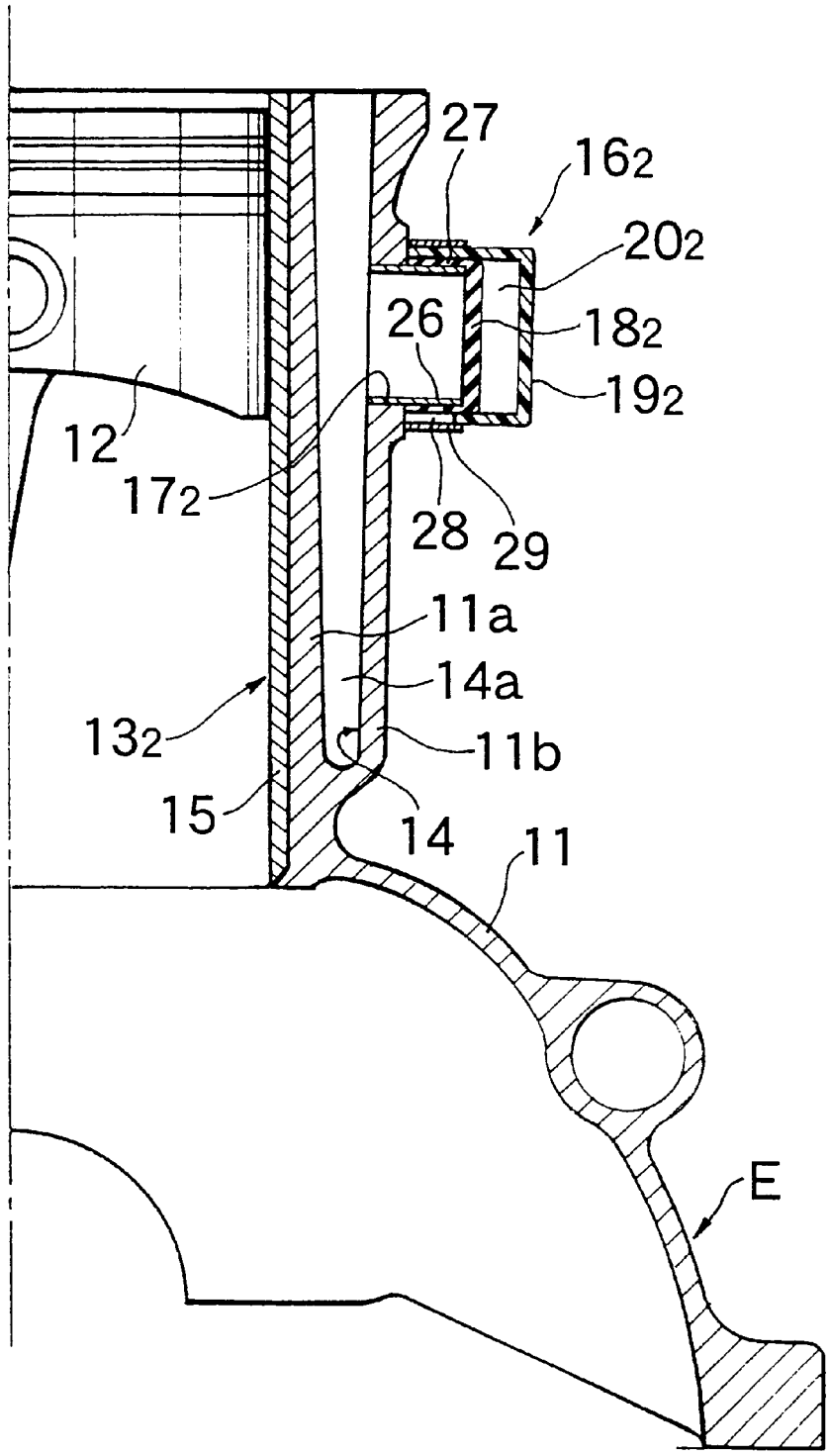
FIG. 6 is a sectional view similar to FIG. 2, but illustrating a second embodiment.

FIG. 6 illustrates a second embodiment of the present invention, wherein portions or components corresponding to those in the first embodiment are designated by like reference characters.

A through-bore $17_2$ is provided in an outer wall 11*b* of a cylinder block 11, and a vibration absorbing means 162 is mounted to the outer wall 11*b* of the cylinder block 11 to close the through-bore $17_2$.

The vibration absorbing means $16_2$ includes a collar 26 which is liquid-tightly press-fitted into the through-bore $17_2$, a resilient membrane $18_2$ having one surface facing the cooling water passageway 14, and a housing $19_2$ which is detachably mounted to the collar 26 to define a space area $20_2$ between the housing $19_2$ and the other surface of the resilient membrane $18_2$.

The collar 26 is cylindrically made from a metal material, and has an inner end which is press-fitted into the through-bore $17_2$ so that it does not protrude from the inner surface of the outer wall 11*b* of the cylinder block 11 into the cooling water passageway 14, and an outer end which protrudes outwards from the outer wall 11*b* of the cylinder block 11.

The resilient membrane $18_2$ is integrally provided with a fitting cylindrical portion 27 into which the protrusion of the collar 26 from the cylinder block 11 is fitted. By fitting of the collar 26 into the fitting cylindrical portion 27, the resilient membrane $18_2$ closes the outer end of the collar 26 with its one surface facing the water passage portion 14*a* of the cooling water passageway 14. The housing $19_2$ is formed into a bottomed cylindrical shape from a synthetic resin, so that the fitting cylindrical portion 27 having the collar 26 fitted therein can be fitted into the housing $19_2$. A space area $20_2$ is defined between the closed outer end of the housing $19_2$ and the resilient membrane $18_2$ and faced by the other surface of the resilient membrane $18_2$. Further, a slit 28 extending axially along the cylindrical portion of the housing $19_1$ is provided at the opened end of the housing $19_2$ in order to facilitate fitting over the fitting cylindrical portion 27, and the outer periphery of the opened end of the housing $19_2$ having the fitting cylindrical portion 27 fitted therein is clamped by a clamping band 29 in a manner to ensure a sealability between the collar 26 and the fitting cylindrical portion 27.

Even according to the second embodiment, an effect similar to that in the first embodiment can be provided and moreover, by the fact that the housing $19_2$ is made from a synthetic resin, the weight of the vibration absorbing means $16_2$ can be reduced.

Figure 7:
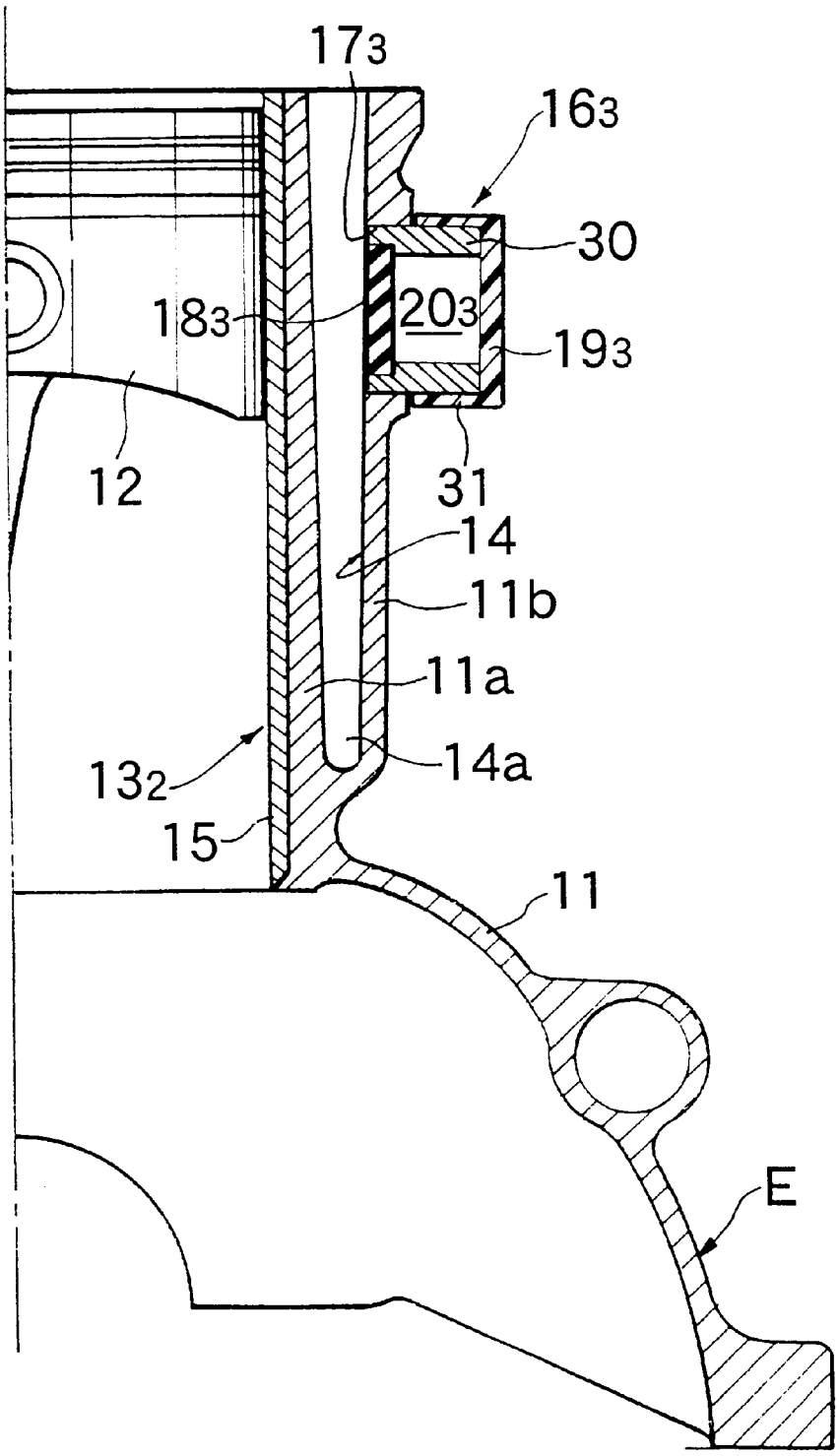
FIG. 7 is a sectional view similar to FIG. 2, but illustrating a third embodiment.

FIG. 7 illustrates a third embodiment of the present invention, wherein portions or components corresponding to those in the previously described embodiments are designated by like reference characters.

A through-bore $\mathbf{17}_3$ is provided in an outer wall 11*b* of a cylinder block 11, and a vibration absorbing means $\mathbf{16}_3$ is mounted to the outer wall 11*b* of the cylinder block 11 to close the through-bore $\mathbf{17}_3$.

The vibration absorbing means $\mathbf{16}_3$ includes a collar 30 which is liquid-tightly press-fitted into the through-bore $\mathbf{17}_3$, a resilient membrane $\mathbf{18}_3$ having one surface facing the water passage portion 14*a* of the cooling water passageway 14, and a housing $\mathbf{19}_3$ which is detachably mounted to the collar 30 to define a space area $\mathbf{20}_3$ between the housing $\mathbf{19}_3$ and the other surface of the resilient membrane $\mathbf{18}_3$.

The collar 30 is cylindrically made from a metal material, and has an inner end which is press-fitted into the through-bore $\mathbf{17}_3$ so that it does not protrude from the inner surface of the outer wall 11*b* of the cylinder block 11 into the water passage portion 14*a* of the cooling water passageway 14, and an outer end which protrudes outwards from the outer wall 11*b* of the cylinder block 11.

A peripheral edge of the resilient membrane $\mathbf{18}_3$ is secured to the inner end of the collar 30, for example, by baking, in such a manner that the inner end of the collar 30 is closed by the resilient membrane $\mathbf{18}_3$. Moreover, the peripheral edge of the resilient membrane $\mathbf{18}_3$ is secured to the inner end of the collar 30, for example, flush with the inner end of the collar 30, in such a manner that it does not protrude from the inner surface of the outer wall 11*b* of the cylinder block 11 into the water passage portion 14*a* of the cooling water passageway 14.

The housing $\mathbf{19}_3$ is formed into a bottomed cylindrical shape and integrally provided with a cylindrical portion 31 into which the protrusion of the collar 30 from the cylinder block 11 is liquid-tightly fitted. The space area $\mathbf{20}_3$ is defined in the collar 30 between the closed outer end of the housing $\mathbf{19}_3$ and the resilient membrane $\mathbf{18}_3$ and faced by the other surface of the resilient membrane $\mathbf{18}_3$.

According to the third embodiment, the operation for mounting and removing the collar 30 to and from the cylinder block 11 and thus the operation for replacing the resilient membrane $\mathbf{18}_3$ is more difficult than the first and second embodiments. However, it is possible to effectively reduce the piston slap sound, while avoiding an increase in weight of the cylinder block 11, and to avoid hindering of the flow of cooling water in the cooling water passageway 14 to the utmost by the resilient membrane $\mathbf{18}_3$ to maintain the cooling performance at the same level as in the prior art. Further, it is possible to stabilize the vibration characteristic of the resilient membrane $\mathbf{18}_3$ to provide an excellent vibration absorbing effect even during a variety of operations of the engine.

Figure 8:
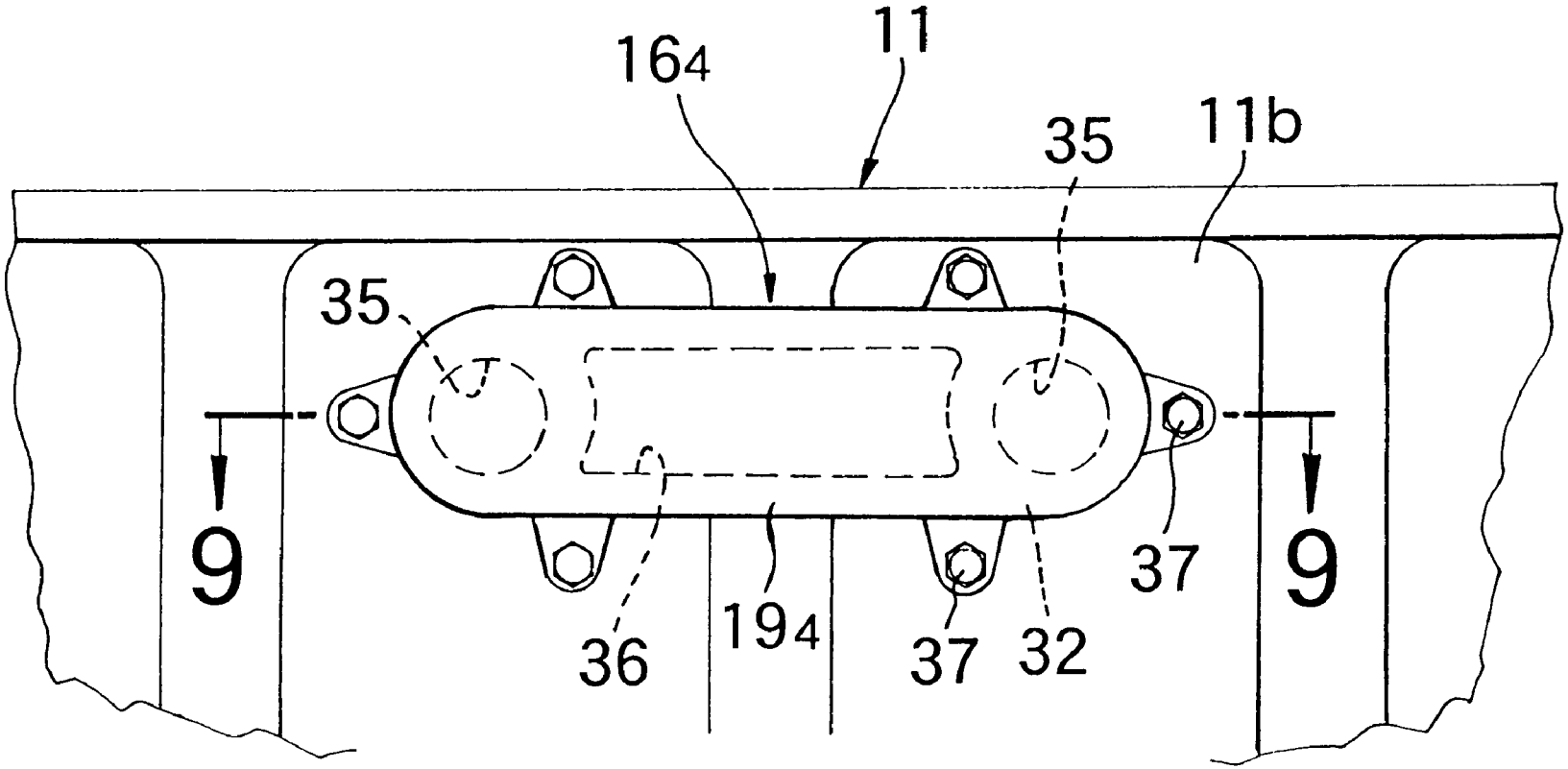
FIG. 8 is a side view of an essential portion of a cylinder block in a fourth embodiment.
Figure 9:
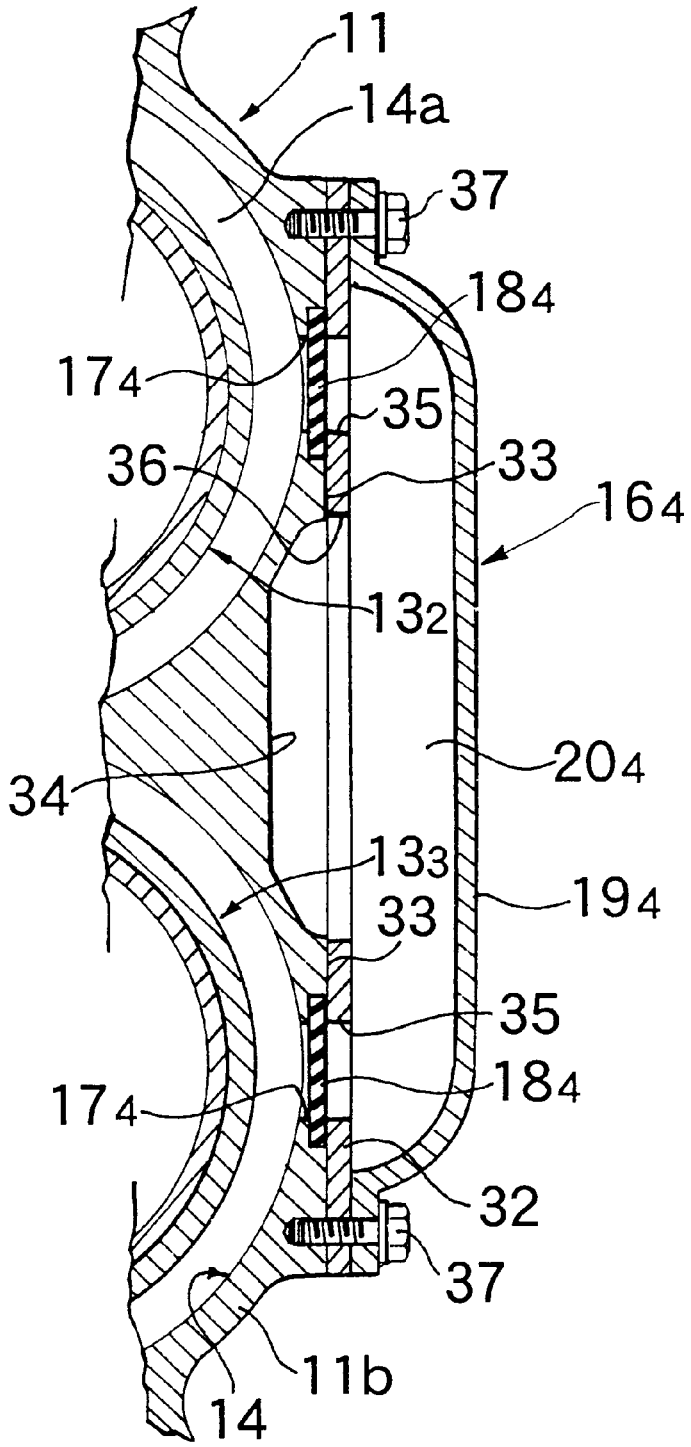
FIG. 9 is a sectional plan view taken along the line 9—9 in FIG. 8.

FIGS. 8 and 9 illustrate a fourth embodiment of the present invention. FIG. 8 is a side view of an essential portion of a cylinder block, and FIG. 9 is a sectional plan view taken along a line 9—9 in FIG. 8.

Through-bores $\mathbf{17}_4$ are provided in an outer wall 11*b* of a cylinder block 11 at portions corresponding to center locations of second and third cylinders $\mathbf{13}_2$ and $\mathbf{13}_3$, respectively. A vibration absorbing means $\mathbf{16}_4$ is mounted to the outer wall 11*b* of the cylinder block 11 from the side of an outer surface in a manner to close the through-bores $\mathbf{17}_4$.

The vibration absorbing means $\mathbf{16}_4$ includes a pair of resilient membranes $\mathbf{18}_4$ each having one surface facing the water passage portion 14*a* of the cooling water passageway 14, a clamp plate 32 which clamps the resilient membranes $\mathbf{18}_4$ between the clamp plate 32 and the outer surface of the cylinder block 11, and a housing $\mathbf{19}_4$ fastened to the cylinder block 11 along with the clamp plate 32 to define a single common space area $\mathbf{20}_4$ between the housing $\mathbf{19}_4$ and the other surfaces of the resilient membranes $\mathbf{18}_4$.

The outer surface of the outer wall 11*b* of the cylinder block 11 is provided with mounting seats 33 faced by outer ends of the through-bores $\mathbf{17}_4$, and a recess 34 disposed between the mounting seats 33. The clamp plate 32 is disposed to liquid-tightly clamp the resilient membranes $\mathbf{18}_4$, each formed into a disk-like shape, between the clamp plate 32 and the mounting seats 33. The clamp plate 32 is provided with through-holes 35 corresponding to the through-bores $\mathbf{17}_4$, and a communication bore 36 disposed between the through-holes 35 and corresponding to the recess 34 in the cylinder block 11.

The housing $\mathbf{19}_4$ is formed to cover the clamp plate 32 from the outside. The outer periphery of the housing $\mathbf{19}_4$ and the clamp plate 32 are commonly fastened at their plural circumferentially spaced points to the cylinder block 11 by bolts 37.

In a state in which the clamp plate 32 and the housing $\mathbf{19}_4$ clamping the resilient membranes $\mathbf{18}_4$ between them and the mounting seats 33 have been fastened to the cylinder block 11, end faces of the resilient membranes $\mathbf{18}_4$ commonly face the space area $\mathbf{20}_4$ defined between the housing $\mathbf{19}_4$ and the cylinder block 11 to have a relatively wide volume.

According to the fourth embodiment, since the vibration absorbing means $\mathbf{16}_4$ corresponding to the second and third cylinders $\mathbf{13}_2$ and $\mathbf{13}_3$ has the single housing $\mathbf{19}_4$ common to the resilient membranes $\mathbf{18}_4$, it is possible to provide reductions in number of parts and number of assembling steps.

Alternatively, the clamp plate 32 and the housing $\mathbf{19}_4$ may be formed integrally with each other.

Figure 10:
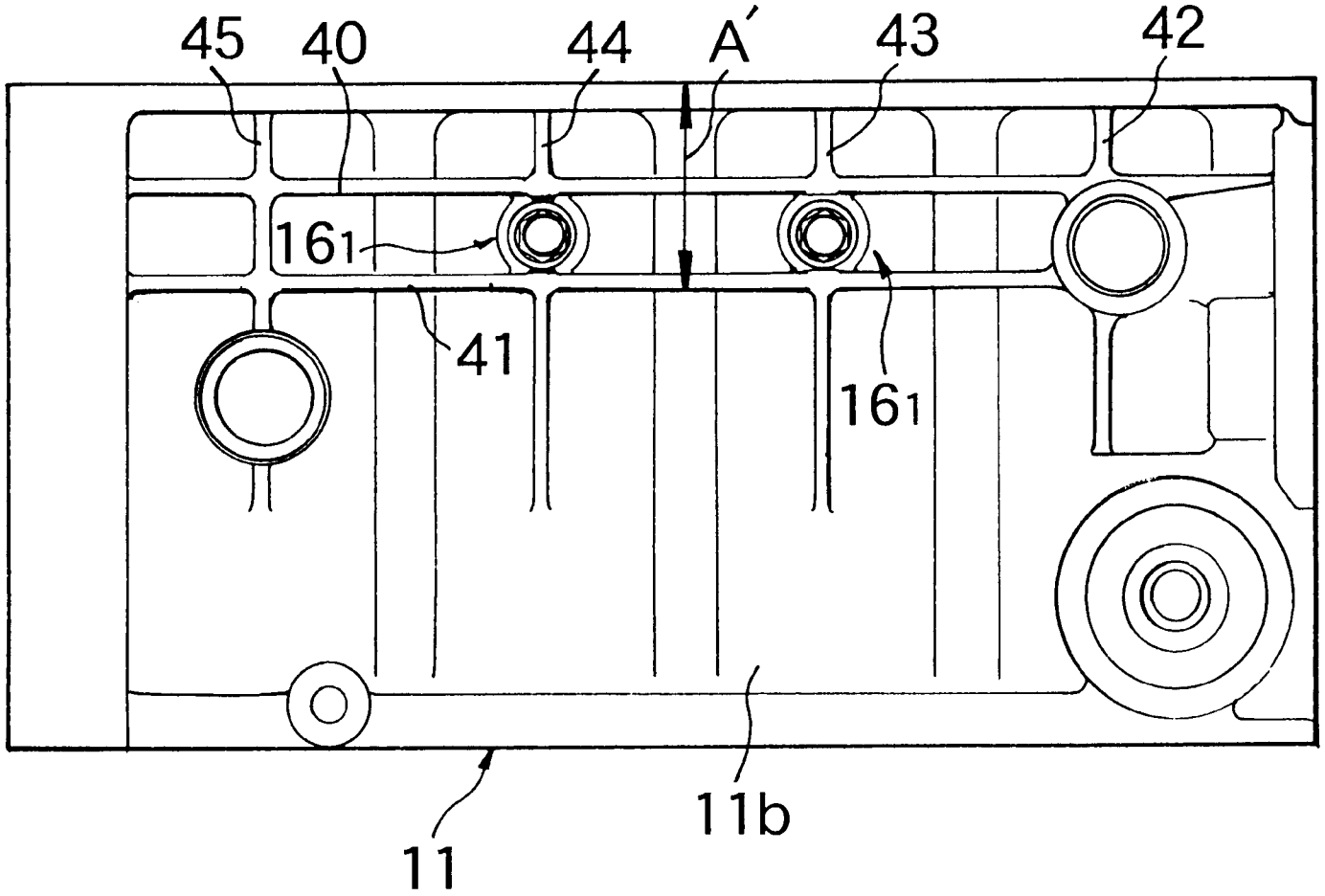
FIG. 10 is a side view of a cylinder block in a fifth embodiment.

FIG. 10 illustrates a fifth embodiment of the present invention. An outer wall 11*b* of a cylinder block 11 is provided with a single or a plurality of (two in this embodiment) transverse ribs 40 and 41 extending in the direction of the arrangement of the cylinders $\mathbf{13}_1$, $\mathbf{13}_2$, $\mathbf{13}_3$ and $\mathbf{13}_4$ (see FIG. 1), and four longitudinal ribs 42, 43, 44 and 45 extending substantially in parallel to axes of the cylinders $\mathbf{13}_1$, $\mathbf{13}_2$, $\mathbf{13}_3$ and $\mathbf{13}_4$ at locations corresponding to the centers of the cylinders $\mathbf{13}_1$, $\mathbf{13}_2$, $\mathbf{13}_3$ and $\mathbf{13}_4$. Moreover, the positions of disposition of the transverse ribs 40 and 41 are limited into a range A' provided by addition of one half of the width of the ribs 40 and 41 to the range A shown in the first embodiment. Vibration absorbing means $\mathbf{16}_1$, for example, as described in the first embodiment, are disposed on the outer wall 11*b* of the cylinder block 11 at locations corresponding to the second and third cylinders $\mathbf{13}_2$ and $\mathbf{13}_3$, respectively.

According to the fifth embodiment, the rigidity of the cylinder block 11 at a portion at which the acceleration produced with the piston slap is especially larger can be enhanced by both of the transverse ribs 40 and 41 and the longitudinal ribs 43 and 44 corresponding respectively to the second and third cylinders $\mathbf{13}_2$ and $\mathbf{13}_3$, and the piston slap sound can be further effectively reduced by cooperation of the enhancement in rigidity provided by the other longitudinal ribs 42 and 45 with the vibration absorbing effect provided by the vibration absorbing means $\mathbf{16}_1$.

Figure 11:
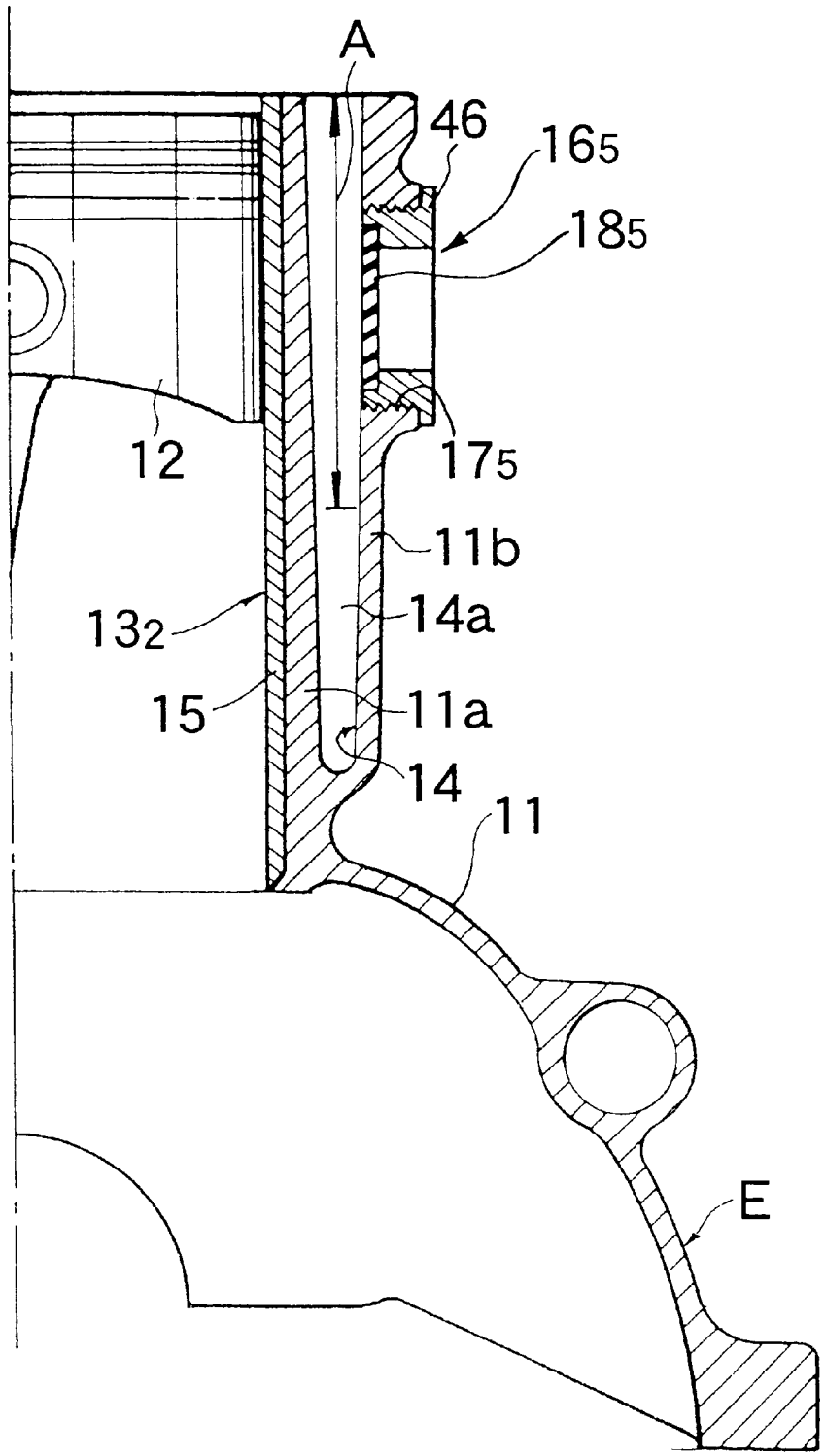
FIG. 11 is a sectional view similar to FIG. 2, but illustrating a sixth embodiment.

FIG. 11 illustrates a sixth embodiment of the present invention. A threaded bore $\mathbf{17}_5$ as a through-bore is provided in an outer wall 11*b* of a cylinder block 11. A vibration absorbing means $\mathbf{16}_5$ is mounted to the outer wall 11*b* of the cylinder block 11 in a manner to close the threaded bore $\mathbf{17}_5$.

The vibration absorbing means $16_5$ includes a resilient membrane $18_5$ which is secured, for example, by baking, to an inner end of a cylindrical support plate 46 liquid-tightly fitted into the threaded bore $17_5$, and which resilient membrane $18_5$ has one surface facing the water passage portion 14*a* of the cooling water passageway 14. The other surface of the resilient membrane $18_5$ faces an external open space as a space area.

Even when the space area faced by the other surface of the resilient membrane $18_5$ is not a closed space as in the sixth embodiment, the piston slap sound can be reduced by absorbing the variation in pressure of the cooling water by the flexure of the resilient membrane $18_5$.

Figure 12:
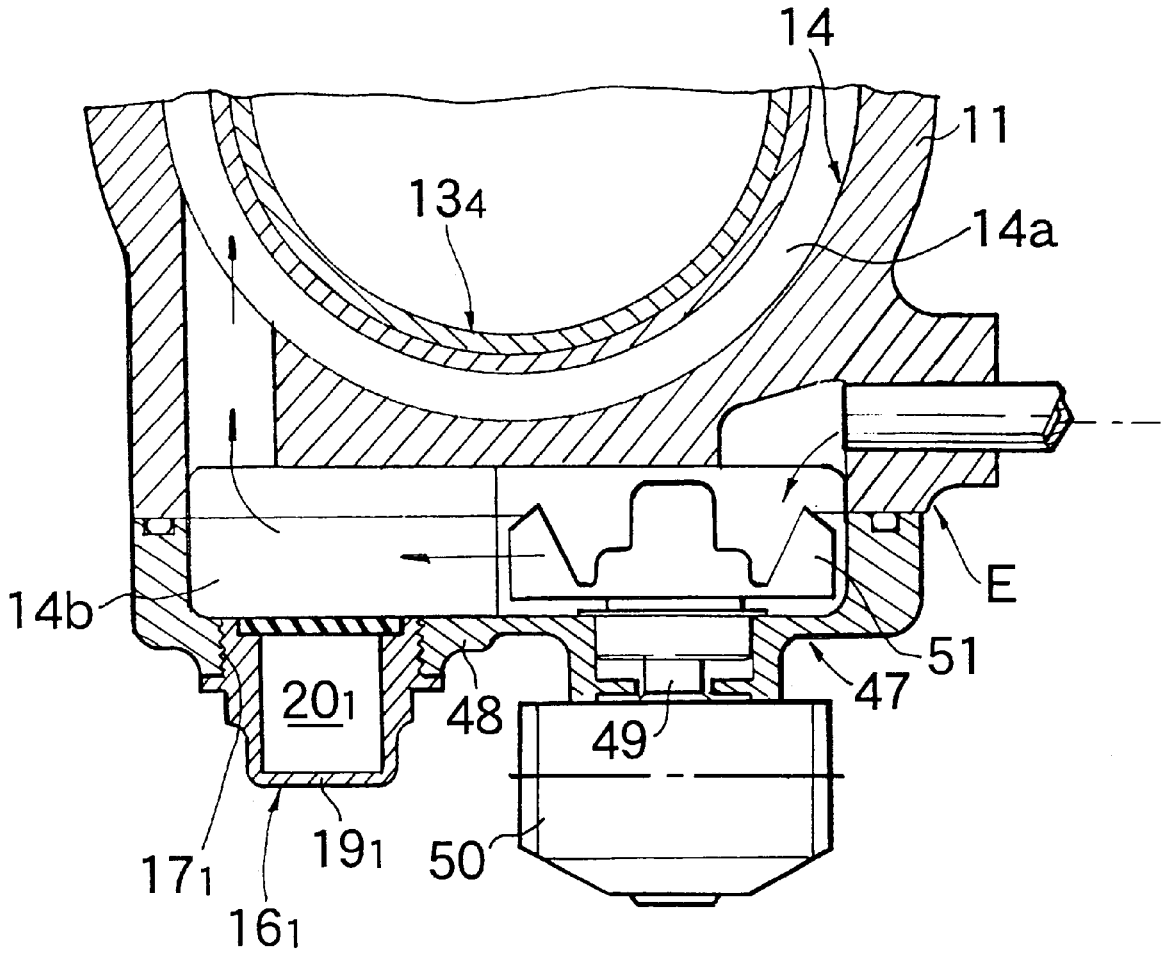
FIG. 12 is a cross-sectional plan view of an essential portion of an engine body in a seventh embodiment.

FIG. 12 illustrates a seventh embodiment of the present invention. A pump housing 48 of a water pump 47 is coupled to the cylinder block 11 to constitute a portion of the engine body E. The water pump 47 is comprised of a pulley 50 mounted at a protrusion (from the pump housing 48) of a rotary shaft 49 rotatably supported in the pump housing 48 for inputting power from a crankshaft (not shown), and an impeller 51 secured to the rotary shaft 49 within the pump housing 48. An outlet passage 14*b* is defined between the pump housing 48 and the cylinder block 11 and constitutes a cooling water passageway 14 together with a water passage portion 14*a* which surrounds the cylinders $13_1$, $13_2$, $13_3$ and $13_4$ (see FIG. 1). Thus, cooling water is discharged from the outlet passage 14*b* into the water passage portion 14*a* as shown by an arrow in FIG. 12 in response to the rotation of the impeller 51.

A threaded bore $17_1$, for example, as a through-bore is provided in that portion of the pump housing 48 serving as an outer wall of the engine body E, which faces the outlet passage 14*b* of the cooling water passageway 14. A vibration absorbing means $16_1$ as described in the first embodiment is mounted to the pump housing 48 in a manner to close the threaded bore $17_1$.

When the construction is such that the vibration absorbing means $16_1$ is disposed in the vicinity of the water pump 47 for circulating the cooling water as in the seventh embodiment, it is possible to reduce the piston slap sound and to effectively prevent the generation of a cavitation in the water pump 47.

Although the embodiments of the present invention have been described in detail, it will be understood that the present invention is not limited to the above-described embodiments, and various modifications in design may be made without departing from the spirit and scope of the invention defined in claims.

For example, the present invention is not limited to the multi-cylinder water cooled-type internal combustion engines including three or more cylinders, but is also applicable to a single-cylinder or two-cylinder water cooled-type internal combustion engine.

What is claimed is:

1. A water-cooled type internal combustion engine comprising at least three cylinders provided in parallel and arranged in a line in a cylinder block of an engine body and having a piston slidably received in cylinder, a cooling water passageway defined in the engine body and including a water passage portion surrounding the cylinders, a through-bore provided at that portion of an outer side wall of the engine body which faces the cooling water passageway and at an intermediate location along the line of cylinders, and a vibration absorbing means mounted on the outer side wall of the engine body to close said through-bore, said vibration absorbing means including a resilient membrane disposed so that a peripheral edge of said resilient membrane does not protrude from an inner surface of the outer wall into said cooling water passageway, said resilient membrane having one surface facing said cooling water passageway and another surface facing a space area.

2. A water-cooled type internal combustion engine according to claim 1, wherein said through-bore is located opposite the piston in a top dead center position of the piston.

3. A water-cooled type internal combustion engine according to claim 1, wherein said vibration absorbing means includes a collar press-fit into said through-hole.

4. A water-cooled type internal combustion engine according to claim 3, wherein said resilient membrane is mounted on an inner end of said collar.

5. A water-cooled type internal combustion engine comprising a cylinder provided in a cylinder block of an engine body and having a piston slidably received in the cylinder, and a cooling water passageway defined in the engine body and including a water passage portion surrounding the cylinder, wherein said internal combustion engine further includes a through-bore provided at that portion of an outer wall of the engine body which faces the cooling water passageway, and a vibration absorbing means mounted to the outer wall surface of the engine body to close said through-bore, said vibration absorbing means including a resilient membrane disposed so that a peripheral edge of said resilient membrane does not protrude from an inner surface of the outer wall into said cooling water passageway, said resilient membrane having one surface facing said cooling water passageway and another surface facing a space area, and wherein said through-bore is threaded, said vibration absorbing means including a bottomed cylindrical housing with external threads on an open end of said housing threadedly engaging said through-bore, and said resilient membrane is mounted in said open end of said housing.

6. A water-cooled type internal combustion engine comprising a cylinder provided in a cylinder block of an engine body and having a piston slidably received in the cylinder, and a cooling water passageway defined in the engine body and including a water passage portion surrounding the cylinder, wherein said internal combustion engine further includes a through-bore provided at that portion of an outer wall of the engine body which faces the cooling water passageway, and a vibration absorbing means mounted to the outer wall surface of the engine body to close said through-bore, said vibration absorbing means including a resilient membrane disposed so that a peripheral edge of said resilient membrane does not protrude from an inner surface of the outer wall into said cooling water passageway, said resilient membrane having one surface facing said cooling water passageway and another surface facing a space area, and wherein said vibration absorbing means includes a collar press-fit into said through-hole and said resilient membrane is mounted on an outer end of said collar and spaced from said outer wall.

7. A water-cooled type internal combustion engine comprising a cylinder provided in a cylinder block of an engine body and having a piston slidably received in the cylinder, and a cooling water passageway defined in the engine body and including a water passage portion surrounding the cylinder, wherein said internal combustion engine further includes a through-bore provided at that portion of an outer wall of the engine body which faces the cooling water passageway, and a vibration absorbing means mounted to the outer wall surface of the engine body to close said through-bore, said vibration absorbing means including a resilient membrane disposed so that a peripheral edge of said resilient membrane does not protrude from an inner surface of the outer wall into said cooling water passageway, said resilient membrane having one surface facing said cooling water passageway and another surface facing a space area, and wherein said vibration absorbing means includes a collar-press-fit into said through-hole and said resilient membrane is in the form of a cup with a cylindrical wall surrounding said collar and a bottom having said one surface and said another surface.

8. A water-cooled type internal combustion engine according to claim 7, wherein said vibration absorbing means includes a bottomed cylindrical housing with a cylindrical wall surrounding said cylindrical wall of said resilient membrane.

9. A water-cooled type internal combustion engine according to claim 8, further including a cylindrical clamp clamping said housing cylindrical wall to said resilient membrane cylindrical wall.

10. A water-cooled type internal combustion engine according to claim 9, wherein a bottom wall of said bottomed cylindrical housing is spaced from said another surface of said resilient membrane for forming said space area therebetween.

11. A water-cooled type internal combustion engine comprising a cylinder provided in a cylinder block of an engine body and having a piston slidably received in the cylinder, and a cooling water passageway defined in the engine body and including a water passage portion surrounding the cylinder, wherein said internal combustion engine further includes a through-bore provided at that portion of an outer wall of the engine body which faces the cooling water passageway, and a vibration absorbing means mounted to the outer wall surface of the engine body to close said through-bore, said vibration absorbing means including a resilient membrane disposed so that a peripheral edge of said resilient membrane does not protrude from an inner surface of the outer wall into said cooling water passageway, said resilient membrane having one surface facing said cooling water passageway and another surface facing a space area, and wherein said vibration absorbing means includes a collar press-fit into said through-hole and said vibration absorbing means includes a bottomed cylindrical housing with a cylindrical wall mounted on an exterior cylindrical wall of said collar.

12. A water-cooled type internal combustion engine comprising a cylinder provided in a cylinder block of an engine body and having a piston slidably received in the cylinder, and a cooling water passageway defined in the engine body and including a water passage portion surrounding the cylinder, wherein said internal combustion engine further includes a through-bore provided at that portion of an outer wall of the engine body which faces the cooling water passageway, and a vibration absorbing means mounted to the outer wall surface of the engine body to close said through-bore, said vibration absorbing means including a resilient membrane disposed so that a peripheral edge of said resilient membrane does not protrude from an inner surface of the outer wall into said cooling water passageways said resilient membrane having one surface facing said cooling water passageway and another surface facing a space area, and wherein two said through-bores are provided with one said through-bore located opposite a second said cylinder adjacent to said one said cylinder, a said resilient membrane positioned to cover each said through-bore, and said vibration absorbing means including a housing extending over and covering, in spaced relationship, both said resilient membranes and both said through-bores.

13. A water-cooled type internal combustion engine comprising a cylinder provided in a cylinder block of an engine body and having a piston slidably received in the cylinder and a cooling water passageway defined in the engine body and including a water passage portion surrounding the cylinder wherein said internal combustion engine further includes a through-bore provided at that portion of an outer wall of the engine body which faces the cooling water passageway, and a vibration absorbing means mounted to the outer wall surface of the engine body to close said through-bore, said vibration absorbing means including a resilient membrane disposed so that a peripheral edge of said resilient membrane does not protrude from an inner surface of the outer wall into said cooling water passageway, said resilient membrane having one surface facing said cooling water passageway and another surface facing a space area, and wherein said through-bore is located in a water pump housing mounted on the engine body, said through-bore located downstream from a water pump.

14. A water-cooled type internal combustion engine comprising at least three cylinders provided in parallel and arranged in a line in a cylinder block of an engine body and having a piston slidably received in each cylinder, a cooling water passageway defined in the engine body and including a water passage portion surrounding the cylinders, a through-bore provided at that portion of an outer side wall of the engine body which faces the cooling water passageway and at an intermediate location along the line of cylinders, and a vibration absorbing means mounted on the outer side wall of the engine body to close said through-bore, said vibration absorbing means including a resilient membrane positioned adjacent said through-bore and having a first surface facing the cooling water passageway and a second surface facing outwardly of the engine block, and a housing covering said resilient membrane and forming a space area between said second surface and said housing, aid space area being of a volume for effectively absorbing vibrations transmitted through the cooling water.

15. A water-cooled type internal combustion engine comprising a cylinder provided in a cylinder block of an engine body, a piston slidably received in the cylinder, a cooling water passageway defined in the engine body and including a water passage portion surrounding the cylinder, a through-bore provided at that portion of an outer side wall of the engine body which faces the cooling water passageway, said through-bore being located opposite the piston in a top dead center position of the piston, and a vibration absorbing means mounted on the outer side wall of the engine body to close said through-bore, said vibration absorbing means including a resilient membrane disposed so that a peripheral edge of said resilient membrane does not protrude from an inner surface of the outer wall into said cooling water passageway, said resilient membrane having one surface facing said cooling water passageway and another surface facing a space area.

16. A water-cooled type internal combustion engine according to claim 15, wherein said through-bore is threaded, said vibration absorbing means including a bottomed cylindrical housing with external threads on an open end of said housing threadedly engaging aid through-bore, and said resilient membrane is mounted in said open end of said housing.

17. A water-cooled type internal combustion engine according to claim 15, wherein said vibration absorbing means includes a collar press-fit into said through hole, and said resilient membrane is mounted on an outer end of said collar and spaced from said outer wall.

18. A water-cooled type internal combustion engine according to claim 17, wherein said resilient membrane is in the form of a cup with a cylindrical wall surrounding said collar and a bottom having said one surface and said another surface.

19. A water-cooled type internal combustion engine according to claim 18, wherein said vibration absorbing means includes a bottomed cylindrical housing with a cylindrical wall surrounding said cylindrical wall of said resilient member.

20. A water-cooled type internal combustion engine according to claim 19, further including a cylindrical clamp clamping said housing cylindrical wall to said resilient member cylindrical wall.

21. A water-cooled type internal combustion engine according to claim 20, wherein a bottom wall of said bottomed cylindrical housing is spaced from said another surface of said resilient membrane for forming said space area therebetween.

22. A water-cooled type internal combustion engine according to claim 17, wherein said resilient membrane is mounted on an inner end of said collar, and said vibration absorbing means includes a bottomed cylindrical housing with a cylindrical wall mounted on an exterior cylindrical wall of said collar.

23. A water-cooled type internal combustion engine according to claim 15, wherein two said through-bores are provided with one said through-bore located opposite a second said cylinder adjacent to said one said cylinder, a said resilient membrane positioned to cover each said through-bore, and said vibration absorbing means including a housing extending over and covering, in spaced relationship, both said resilient membranes and both said through-bores.

24. A water-cooled type internal combustion engine according to claim 15, wherein said through-bore is located in a water pump housing mounted on the engine body, said through-bore located downstream from a water pump.

* * * * *